US009989294B2

(12) United States Patent
Romanillos Vazquez

(10) Patent No.: US 9,989,294 B2
(45) Date of Patent: Jun. 5, 2018

(54) ICE-CUTTING MACHINES

(71) Applicant: ABR INGENIEROS, S.L., Madrid (ES)

(72) Inventor: Máximo Romanillos Vazquez, Madrid (ES)

(73) Assignee: ABR INGENIEROS, S.L., Madrid (ES)

( * ) Notice: Subject to any disclaimer, the term of this patent is extended or adjusted under 35 U.S.C. 154(b) by 0 days. days.

(21) Appl. No.: 14/419,348

(22) PCT Filed: Apr. 15, 2014

(86) PCT No.: PCT/ES2014/070311

§ 371 (c)(1),
(2) Date: Feb. 3, 2015

(87) PCT Pub. No.: WO2015/104434

PCT Pub. Date: Jul. 16, 2015

(65) Prior Publication Data

US 2016/0305700 A1 Oct. 20, 2016

(30) Foreign Application Priority Data

Jan. 10, 2014 (ES) ..... 201430027 U

(51) Int. Cl.
*F25C 5/02* (2006.01)

(52) U.S. Cl.
CPC ..... *F25C 5/02* (2013.01)

(58) Field of Classification Search
CPC ..... F25C 5/02; F25C 5/14; F25C 5/16; A47J 43/04
See application file for complete search history.

(56) References Cited

U.S. PATENT DOCUMENTS 2,563,120 A * 8/1951 Klingens ..... B26D 1/153 83/174
D718,085 S * 11/2014 Elek ..... D7/383
2012/0154660 A1* 6/2012 Hirayama ..... G03B 13/04 348/333.01

FOREIGN PATENT DOCUMENTS

ES 1059187 U * 3/2005 ..... F25C 5/02
KR 20120020884 A 3/2012
WO 2011033149 A1 3/2011

OTHER PUBLICATIONS

Maximo (ES 105 9187) translation.*

* cited by examiner

*Primary Examiner* — R. K. Arundale
*Assistant Examiner* — Joseph Finan, Jr.
(74) *Attorney, Agent, or Firm* — Porzio Bromberg Newman P.C.

(57) ABSTRACT

Ice-cutting machine comprising a cylindrical tank (1) on the upper portion of which two circular blades (2) are arranged, being raised at a certain height above a supporting assembly (3), which constitutes the supporting base of the cylindrical bars, provided with one rotation motor (4) and another translation motor (5) that impart a compound rotational and translational motion, wherein the supporting assembly (3) is provided with two crescent-shaped supports (3.1) that have a ramp (3.2), which prevents the ice bars from being damaged by the teeth of the blades; the blades are fixed by means of screws (2.2); the cylindrical tank (1) is provided with a register flap (6) and the rotation motor (4) is fixed on a platform (8) which in turn is fixed to the cylindrical tank (1), and the rotation motor (4) and platform assembly is covered by a casing (8).

2 Claims, 2 Drawing Sheets

ICE-CUTTING MACHINES

OBJET OF THE INVENTION

The present invention relates to an improved ice-cutting machine, which may fit to the lower section of a freezer producing ice in the form of cylindrical bars and that is placed underneath it, in such a way that it cuts the bars at a certain size when they fall by gravity thereupon.

Said cutting machine enables achieving a large production of ice-cubes due to the high number of bars that are obtained in the freezer and the speed with which the process takes place.

To do this end, by using rotating cutting elements, which are located on the upper portion of said cutting machine and whose axis is parallel to that of the ice bars, a clean cut is obtained with the resulting high quality of the final product that comes outside through an unloading area.

The machine has been the object of reinforcements in the supporting tray, the securing elements of the blades, the access to the inside of the machinery of the cutting machine and improvements in the guiding of the ice bars when they fall upon the supporting assembly, thus reducing vibrations and stress on the bearings.

Therefore, the present invention is encompassed within the scope of the ice-cutting machines, and particularly those which may fit to the lower section of a freezer producing bars of ice.

BACKGROUND OF THE INVENTION

In the state of the art, ice-cutting machines which may fit to the lower section of a freezer producing cylindrical bars of ice and where the cutting machine is placed under the freezer producing the bars of ice, in such a way that it cuts the bars along a plane perpendicular to their axis resulting in the formation of ice cubes with a specific height, are known.

These ice-cutting machines are made up of a cylindrical tank that houses in its interior at least the ice cubes cutting and unloading system, being it possible, for space economy purposes, to further incorporate other auxiliary elements of the freezer.

The cutting elements are two circular blades placed on the upper portion of the cylindrical tank, raised at a certain height above the supporting assembly that constitutes the supporting base of the bars, being possible to vary that height, so as to obtain cubes of different length.

In order to make the bars of ice to fall by gravity, a fluid at high temperature is introduced between the tubes of the freezer, and so these bars come to rest against the supporting assembly or against the circular blades themselves.

However, these machines have aspects that could be improved, such as for example high vibrations, bars of ice eventually bumping against the base of the blades, instability of the blades, and access to the inside of the machine to increase output and replace parts.

Therefore, the aim of the present invention is to develop an ice-cutting machine that may fit to the lower section of a freezer producing cylindrical bars of ice, which overcomes the aforementioned disadvantages by developing a machine like the one described below and that is reflected in its essentiality in the first claim.

DESCRIPTION OF THE INVENTION

The present invention relates to an ice-cutting machine that may fit to the lower section of a freezer producing cylindrical bars of ice and that is placed underneath said freezer, in such a way that it cuts the bars along a plane perpendicular to their axis resulting in the formation of ice cubes with a specific height.

The ice-cutting machines is made up of a cylindrical tank that houses in its interior at least the ice cubes cutting and unloading system, being it possible, for space economy purposes, to further incorporate other auxiliary elements of the freezer.

The cutting elements are two circular blades placed on the upper portion of the cylindrical tank, raised at a certain height above the supporting assembly that constitutes the supporting base of the bars, being possible to vary that height so as to obtain cubes of different length. This supporting assembly is provided with two crescent-shaped supports that have a ramp, which prevents the ice bars that are going to pass from the upper portion of the blade to the supporting assembly from being damaged by the teeth of the blades and also prevents them from passing in an abrupt manner, since the ramp acts as a slide and the bars are gently "deposited" upon the supporting assembly, instead of dropping suddenly under the effects of gravity.

Moreover, in order to increase the stability and to achieve a better fastening, given the stresses they are subjected to, the blades are provided with a larger number of fixing points and are farther apart from the axle.

In addition, and with the aim of gaining access to the interior of the container where the mechanisms transmitting the rotation from the motors to the blades are found, a removable access flap is arranged on top of the container.

Finally, the motor transmitting rotation to the assembly, in order to generate as few vibrations as possible is arranged on a platform, which is firmly fixed to the cylindrical tank and covered with a protective casing.

DESCRIPTION OF THE DRAWINGS

To complete the description and with the aim of aiding a better understanding of the features of the invention, according to one practical embodiment thereof, attached as an integral part of the description is a set of figures, wherein by way of non-limitative example, the following has been represented.

PREFERRED EMBODIMENT OF THE INVENTION

In view of the figures, a preferred embodiment of the proposed invention is described below.

Figure 1:
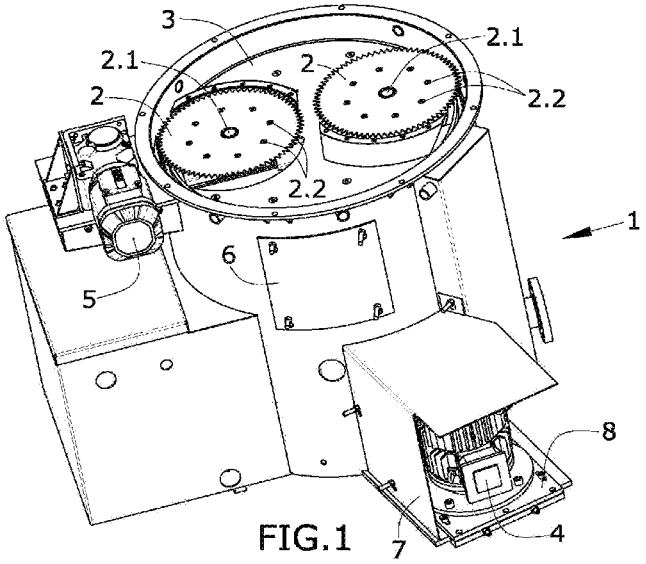
FIGS. 1 and 2 show different perspective views of the ice-cutting machine, object of the invention, wherein the constructive improvements can be appreciated.
Figure 2:
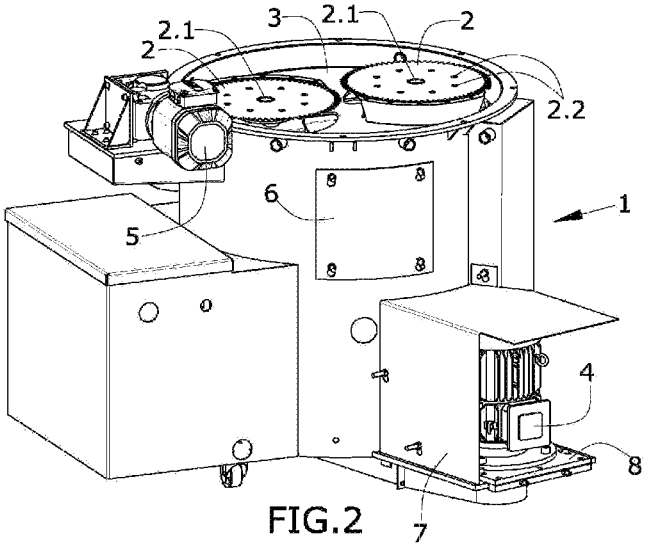
Figure 3:
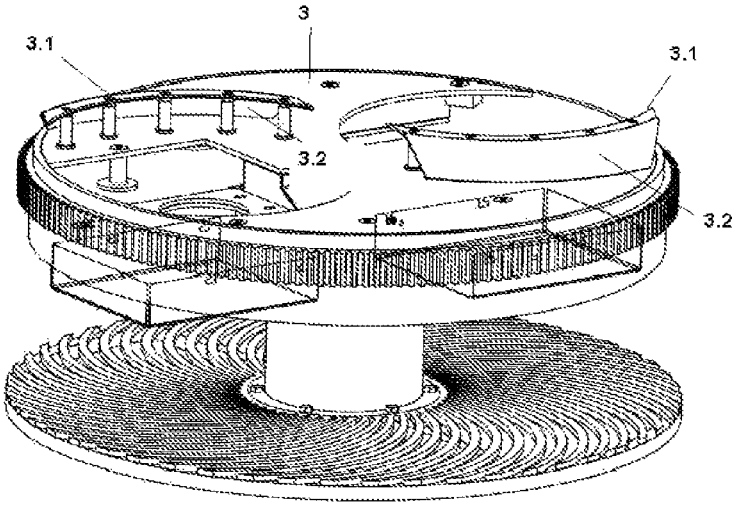
FIG. 3 is a representation of the supporting assembly on top of which two crescent-shaped supports are arranged.

The present invention, as shown in FIG. 1, relates to an ice-cutting machine which may fit to the lower section of a freezer producing cylindrical bars of ice and that is placed underneath said freezer, in such a way that it cuts the cylindrical bars along a plane perpendicular to their axis resulting in the formation of ice cubes with a specific height.

The ice-cutting machine is made up of a cylindrical tank (1) that houses in its interior the cutting and unloading system of the ice cubes, while it stores the water necessary for their formation.

The cutting elements are two circular blades (2) placed on the upper portion of the cylindrical tank (1), raised at a certain height above a supporting assembly (3) that constitutes the supporting base of the cylindrical bars, and placed opposite relative to a central axis of the cylindrical tank (1), being the axle (2.1) of said circular blades (2) parallel to said axis.

Due to the cutting movement, all the cylindrical bars coming from the freezer, initially resting either against the supporting assembly (3) or against the circular blades (2), are cut by the latter as they carry out a movement composed by a rotation and a circular translation, each one of them being obtained by the rotational motion of a rotating motor (4) and a translation motor, respectively.

By means of the rotation each one of the circular blades (2) rotates on the axle (2.1) that passes through their center and by means of the translation the circular blades (2) revolve around the axis of the cylindrical tank (1) thus covering its entire section.

The rotation is generated by the rotational motion of a rotation motor (4) that is fixed to a lower support (8), which in turn is firmly fixed to the tank (1), the entire assembly being covered with a casing (7)

The cutting blades are fixed to a holding platform by means of a number of fastening screws (2.2), which in a possible embodiment are eight fixing points, with the aim of ensuring the stability and correct fastening of the cutting blades.

On the supporting assembly (3) and in the rear portion of each blade two crescent-shaped supports (3.1) have been added, which have a ramp (3.2) that prevents the ice bars that are going to pass from the upper portion of the blade to the supporting assembly (3) from being damaged by the teeth of the blades and also prevents them from passing in an abrupt manner, since the ramp acts as a slide and the bars are gently "deposited" upon the supporting assembly, instead of dropping suddenly under the effects of gravity.

On the lateral side of the cylindrical tank (1) there is a register flap, or gate (6) that allows accessing the interior of the same, which enables to carry out the maintenance and repair works on the motion transmitting mechanisms.

Having described the nature of the present invention in sufficient detail, as well as the way it is put into practice, it is hereby stated that, in its essential form, it can be put into practice in other embodiments that may differ in detail from the one indicated by way of example, embodiments to which the protection sought herein shall equally extend, provided its basic principle is not altered, changed or modified.

The invention claimed is:

1. An ice-cutting machine comprising a cylindrical tank on an upper portion of which two circular blades are arranged, the circular blades being raised above a rotating supporting assembly that constitutes a supporting base configured for receiving cylindrical ice bars, the ice-cutting machine is provided with one rotation motor and one translation motor that impart a compound rotational and translation motion to the circular blades, two crescent-shaped supports, each of the crescent-shaped supports being fixed to the rotating supporting assembly, each of the crescent-shaped supports have a ramp with an upper surface at a level of the blades which prevents a plurality of the cylindrical ice bars received at the rotating supporting assembly from contacting teeth of the blades, the ramp extending from the upper surface to a lower surface defined by the rotating supporting assembly;

the circular blades are fixed by means of screws to a holding platform;

the cylindrical tank is provided with a register flap and the rotation motor is fixed on a platform, which is in turn fixed to the cylindrical tank, and the rotation motor and platform assembly is covered with a casing.

2. The ice-cutting machine according to claim 1, wherein the number of screws used for fixing the circular blades is eight.

* * * * *